US005807127A

United States Patent [19]

Ohshima

[11] Patent Number: 5,807,127

[45] Date of Patent: Sep. 15, 1998

[54] ELECTRIC CONNECTING APPARATUS

[75] Inventor: Hisao Ohshima, Kawaguchi, Japan

[73] Assignee: Enplas Corporation, Saitama, Japan

[21] Appl. No.: 625,110

[22] Filed: Apr. 1, 1996

[30] Foreign Application Priority Data

Mar. 31, 1995 [JP] Japan ..... 7-100700

[51] Int. Cl.[6] ..... H01R 11/22

[52] U.S. Cl. ..... 439/266; 439/342

[58] Field of Search ..... 439/265–268, 439/330, 331, 342, 68, 72, 73, 71

[56] References Cited

U.S. PATENT DOCUMENTS 4,331,371 5/1982 Ichimura et al. ..... 439/342 X
5,147,213 9/1992 Funk et al. ..... 439/266
5,186,642 2/1993 Matsuoka et al. ..... 439/266 X
5,254,012 10/1993 Wang ..... 439/342 X
5,320,550 6/1994 Uratsuji et al. ..... 439/266

*Primary Examiner*—Khiem Nguyen
*Attorney, Agent, or Firm*—Fish & Richardson P.C.

[57] ABSTRACT

An open top type electric connecting apparatus having a base member provided with contact pins and a moving plate which is provided on the base member so that it can move in a lateral direction and which is engaged with the upper end portions of the contact pins. The base member and the moving plate are connected by an X-shaped link mechanism constituting a toggle joint. An operating member is vertically moveably supported by the X-shaped link mechanism.

9 Claims, 4 Drawing Sheets

ELECTRIC CONNECTING APPARATUS

BACKGROUND OF THE INVENTION

1. Field of the Invention

The present invention relates to an electric connecting apparatus for detachably mounting an electrical component such as an IC module in which a large number of pin-like or sphere-like electrodes project from the bottom surface and electrically connecting the electrical component to a circuit substrate.

2. Description of the Related Art

An open top type electric connecting apparatus for detachably mounting an electrical component such as an IC module in which a large number of pin-like or sphere-like electrodes project from the bottom surface and electrically connecting the component to the circuit substrate is provided with, as shown in for example Japanese Unexamined Paten Publication (kokai) No. 4-19979, a base member holding a large number of contact pins having upper end portions which can be opened or closed, a moving plate supported by the base member so that it can move in a lateral direction and engaged with the upper end portions of the contact pins, and an operating member which can vertically move with respect to the base member. It is configured so that the upper end portions of the contact pins are made to open against the biasing force in the closing direction of the contact pins per se by moving the moving plate in the lateral direction by a downward pressing force of the operating member. The pin-like electrodes of the electrical component are inserted into the contact pins with the opened upper end portions from the top, then the contact pins are closed by the biasing force of the contact pins per se and made to grip the pin-like electrodes, whereby the pin-like electrodes and the contact pins are electrically connected to the electrical component. Note that, there also exists a contact pin configured to be brought into contact with or separated from the pin-like or sphere-like electrodes of the electrical component by displacement.

In the conventional electric connecting apparatus explained above, to move the moving plate in the lateral direction by the downward pressing force of the operating member, a lever utilizing the lever principle has been used. Accordingly, the downward pressing force of the operating member which is necessary for making the contact pins open can be reduced to a certain extent by the lever principle. However, the biasing force in the closed direction of the contact pins is increased along with an increase of the amount of downward pressing of the operating member, while with a lever utilizing the lever principle, there is a problem that a larger operating force, that is, downward pressing force, becomes necessary along with an increase of the amount of downward pressing of the operating member.

SUMMARY OF THE INVENTION

Accordingly, an object of the present invention is to provide an electric connecting apparatus which solves the above problem and can greatly reduce the operating force needed for displacing the contact pins.

So as to achieve the above object, the present invention provides an electric connecting apparatus which is provided with a base member holding a plurality of contact pins with upper end portions which can be displaced and a moving plate which is held by the base member so that it can move in the lateral direction and which is engaged with the upper end portions of the contact pins, wherein the base member and the moving plate are connected to the base member and the moving plate by an X-shaped link mechanism constituting a toggle joint and the operating member is vertically moveably supported by the X-shaped link mechanism.

In the electric connecting apparatus having the above configuration, since the base member and the moving plate are connected to the base member and the moving plate by the X-shaped link mechanism constituting the toggle joint and the operating member is vertically moveably supported by the X-shaped link mechanism, the moving plate can be moved in the lateral direction by the action of the toggle joint against the biasing force of the contact pins per se via the X-shaped link mechanism by the downward pressing action of the operating member. In this case, since the toggle joint action of the X-shaped link mechanism is utilized, the multiplication of the moving force (output) in the lateral direction of the moving plate with respect to the downward pressing force (input) of the operating member is increased along with an increase of the amount of downward pressing of the operating member, thus it is not necessary to increase the operating force (downward pressing force) of the operating member when the amount of displacement of the contact pins is increased. Accordingly, the operating force necessary for the opening of the contact pins can be greatly reduced.

In a preferred aspect of the present invention, the X-shaped link mechanism has a pair of link members having substantially the same length which are pivotally connected to each other at an intermediate position (does not always have to be the center position in the horizontal direction, the same for the following description), one of the lower end portions of the pair of link members is pivotally connected to the base member and the other is pivotally connected to the moving plate, and one of the upper end portions of the pair of link members is connected to the operating member via a connection pin which can only pivot and the other is connected to the operating member via a connection pin which can pivot and move in the lateral direction.

In another preferred aspect of the present invention, the X-shaped link member has a pair of link members having the same length which are pivotally connected to each other at an intermediate position, one of the lower end portions of the pair of link members is pivotally connected to the base member and the other is pivotally connected to the moving plate, and one of the upper end portions of the pair of link members is connected to the operating member via a connection pin which can only pivot and the other is connected to the operating member via a connection pin which is fixed to the operating member and can pivot with respect to the link member and can move in the longitudinal direction thereof.

In both aspects of the electric connecting apparatus, one end portion can be moved in the lateral direction by the downward pressing action of the operating member while holding the parallel state of the operating member with respect to the base member. Further, the parallel state of the operating member with respect to the base member can be held also at the upward pulling action of the operating member.

Further, preferably, one of the lower end portions of the pair of link members is connected to the base member via a connection pin which can only pivot, the other is connected to the moving plate via a connection pin which can pivot and move in the lateral direction, and a return spring biasing the operating member upward is arranged between the operating member and the base member.

In the electric connecting apparatus having the above configuration, since one of the lower end portions of the pair of link members is connected to the base member via a connection pin which can only pivot, the other is connected to the moving plate via a connection pin which can pivot and move in the lateral direction, and a return spring biasing the operating member upward is arranged between the operating member and the base member, after the contact pins grip the pin-like electrodes of the electric part, the operating member can be returned to the upper position by the spring force of the return spring. Namely, the lower end portion of one rib and the moving plate are connected to the moving plate via the connection pin which can pivot and move in the lateral direction, therefore in a state where the contact pins grip the pin-like electrodes of the electrical component, the operating member becomes able to vertically move with respect to the base member. Accordingly, when the operating member is pulled up etc., the contact pins can be held in a free state with respect to the operating member, therefore it is possible to prevent an excessive load from being applied upon the contact pins and the pin-like electrodes of the electrical component.

Further, preferably, a pair of left and right X-shaped link mechanisms are provided.

According to the electric connecting apparatus having the above configuration, it is possible to make the moving plate stably and reliably move in the lateral direction and the operating member to perform the operation in the vertical direction with respect to the base member.

The above and other objects and advantages of the present invention will be more apparent from the following detailed explanation given with reference to the accompanying drawings.

DESCRIPTION OF THE PREFERRED EMBODIMENTS

Below, an embodiment of the present invention will be explained with reference to the drawings.

Figure 7:
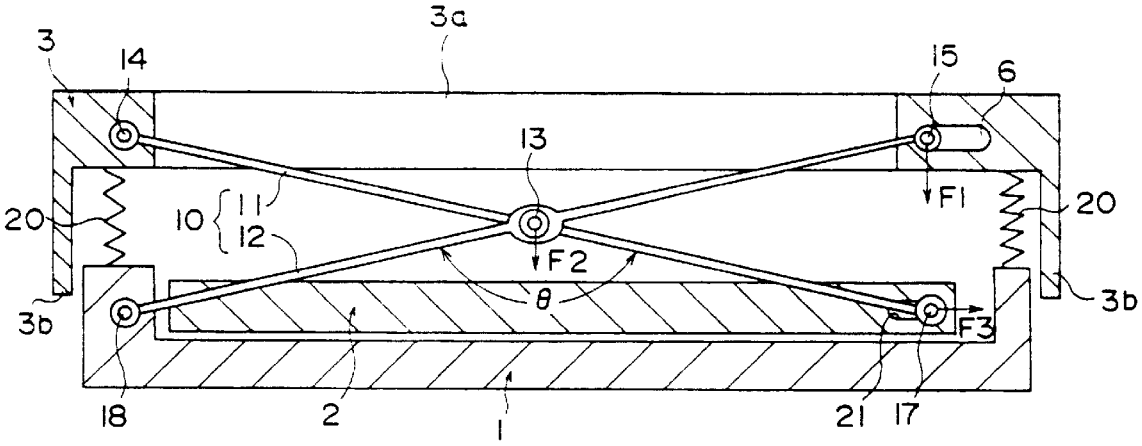
FIG. 7 is a schematic explanatory view for explaining the principle of operation of the present invention.

First, the principle of the operation of the electric connecting apparatus according to the present invention will be explained referring to FIG. 7. FIG. 7 is simplified and schematically drawn, in which 1 denotes a base member, 2, a moving plate, and 3, an operating member, respectively. The base member 1 holds a large number of contact pins, the illustration of which being omitted. The moving plate 2 is held on the base member 1 so that it can move in the lateral direction (horizontal direction in FIG. 7). The operating member 3 is arranged above the base member 1 and the moving plate 2, and a downward force is applied to this manually or by robot hands etc. The operating member 3 is shaped as a whole in the form of a frame having an opening 3*a* through the center of which the electrical component such as an IC module can be inserted.

In FIG. 7, reference numeral 10 shows the X-shaped link mechanism constituting the toggle joint with respect to the base member 1 and the moving plate 2. This X-shaped link mechanism is provided with first and second link members 11 and 12 having the same length. The respective link members 11 and 12 are pivotally connected by the pin 13 at an intermediate position.

The upper end portion of the first link member 11 is pivotally connected to the left end portion of the operating member 3 by the pin 14. The upper end portion of the second link member 12 is pivotally connected to the right end portion of the operating member 3 by the pin 15. The pin 15 is inserted into an elongated hole 16, formed extending in the lateral direction in the operating member 3, without looseness in the vertical direction, and the upper end portion of the second link member 12 is made to be able to relatively slide with respect to the operating member 3 exactly by a predetermined distance in the lateral direction. The line extending from the axial line of this elongated hole 6 is set so as to pass through the center of the pin 14. Note that, instead of providing the elongated hole 16 in the operating member 3, it is also possible to form the elongated hole extending in the longitudinal direction in the upper end portion of the first link member 11 and pivotally engage the connection pin affixed in position to the operating member 3 in the elongated hole of the first link member 11.

The lower end portion of the first link member 11 is connected to the moving plate 2 by the pin 17 which is engaged with the elongated hole 21 formed in the right end portion of the moving plate 2 so that it can pivot and can move in the lateral direction. The lower end portion of the second link member 12 is pivotally connected to the left end portion of the base member 1 by the pin 18. The setup is made so that the line connecting the lower pins 17 and 18 become parallel with respect to the line connecting the upper pins 14 and 15. The connection portions of the pins 13, 14, 15, 17, and 18 are prevented from being loose in the vertical direction. The distances of the pins 14, 15, 17, and 18 with respect to the pin 13 become equal to each other.

Due to the above configuration, the base member 1, the moving plate 2, and the operating member 3 constitute a parallel crank mechanism utilizing the X-shaped link mechanism 10. Thus, when the operating member 3 is displaced in the vertical direction with respect to the base member 1 and the moving plate 2, the parallel state of the members 1, 2, and 3 is held. In addition to this, the base member 1 and the moving plate 2 are made to slip with respect to each other, and the toggle joint is constituted by including the pins 13, 17, and 18.

The return spring 20 is arranged between the base member 1 and the operating member 3, and the operating member 3 is constantly biased upward. Also, the setup is made so that the movement and displacement of the moving plate 2 to the right direction in FIG. 7 becomes the movement in the opening direction of the contact pins, the illustration of which being omitted.

In the above configuration, when the downward force is applied to the operating member 3 from the state of FIG. 7, the operating member 3 is moved downward while holding the parallel state with respect to the base member 1 and the moving plate 2. By the downward movement of this operating member 3, the pin 17, that is, the moving plate 2, is moved to the right direction in FIG. 7, and the contact pins are opened. In a state where the contact pins are opened, the large number of pin-like electrodes of the electrical component approaching the moving plate 2 from above through the center opening 3*a* are inserted into the opened contact pins. Thereafter, when the downward force to the operating member 3 is released, the contact pins close by the biasing force in their closing direction and grip the pin-like electrodes of the electrical component. Also, the operating member 3 is returned to the upper position by the return spring 20 and, at the same time, the contact pins are automatically closed and the contact pins and the pin-like electrodes of the electrical component become electrically connected. Note that, as mentioned before, it is also possible to form the electrical component in a manner that that sphere-like electrodes project from the bottom surface.

When the moving plate 2 slides in the lateral direction, there is no unnecessary pivoting force acting with respect to the base member 1 at the moving plate 2, and a smooth sliding movement of the moving plate 2 in the lateral direction is secured.

Here, the downward force to the operating member 3 acts as a downward force F1 with respect to the upper pin 15. This force F1 is transferred to the pin 13 as a force F2, and the force F2 is increased larger than the force F1. Namely, this means that a force F2 having a magnitude inversely proportional to the ratio of lengths of the first distance between the pin 13 and the pin 18 and the second distance between the pin 18 and the pin 15 is obtained from the force F1.

The force F2 becomes the input in the toggle joint, and the output of this toggle joint becomes a force F3 making the moving plate 2 slidingly move in the lateral direction. Namely, the force F3 becomes the force of a further increased force F2 and can open the contact pins with a large force. Further, in the toggle joint, the larger the angle Θ formed by the two link members 11 and 12 in FIG. 7, the greater the multiplication of the output and the larger the amount of rightward displacement of the moving plate 2 in FIG. 7, that is, the larger the amount of opening of the contact pins, the larger this Θ. That is, this means that the multiplication of the output is increased as the amount of opening of the contact pins becomes larger.

Next, an explanation will be made of a more specific example of the electric connecting apparatus while referring to FIG. 1 to FIG. 4, FIGS. 5A to 5D, and FIGS. 6A to 6C. In these figures, the configurations of the portions other than the portion in relation to the X-shaped link mechanism 10 shown in FIG. 7 are the same as those of the conventional connector, so the explanation thereof will be kept simple.

FIG. 1 to FIG. 4 show an electric connecting apparatus as a whole. In the figures, 31*a* denotes lead portions of the contact pins 31, projected downward from the bottom surface of the base member 11 and electrically connected to the circuit substrate (not illustrated) . Also, a pair of left and right (a pair of front and rear) X-shaped link mechanisms 10 are provided as a whole and can stabilize the movement of the moving plate 2 in the lateral direction and the vertical movement of the operating member 3.

Figure 5C:
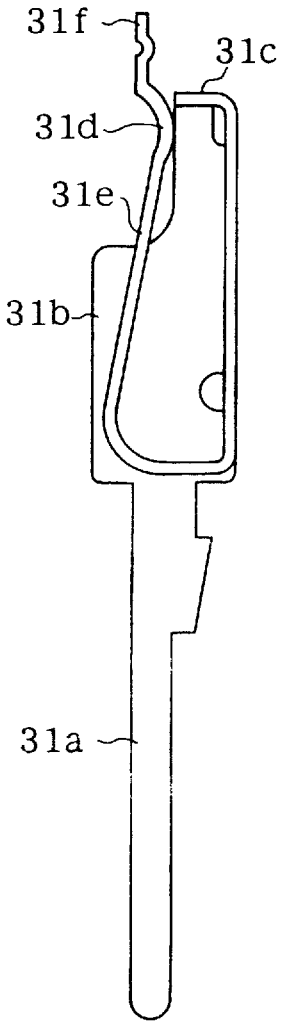
FIGS. 5A, 5B, 5C, and 5D are a front view, a right side view, a back view, and a bottom view showing one example of a contact pin, respectively.
Figure 5B:
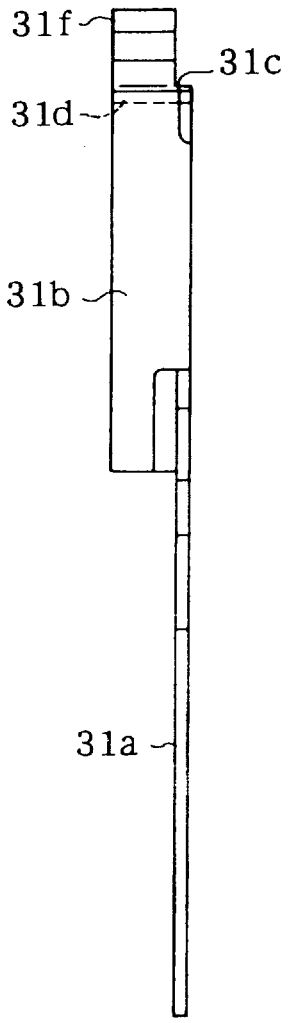
Figure 5A:
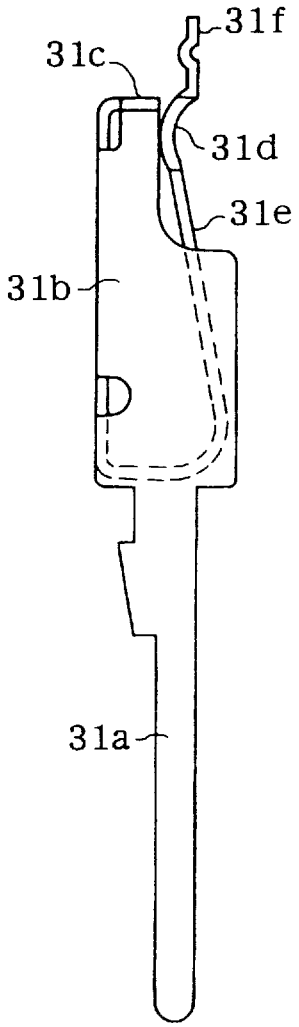
Figure 5D:
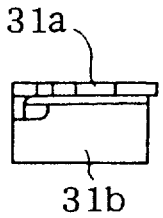

One example of a contact pin 31 is shown in FIGS. 5A, 5B, 5C, and 5D. FIG. 5A is a left side view of the contact pin 31; FIG. 5B is a front view of the contact pin; FIG. 5C is a right side view of the contact pin; and FIG. 5D is a bottom view of the contact pin. This contact pin 31 has a main body 31*b* above the lower side connection terminal 31*a* and has a fixed terminal portion 31*c* having substantially a horizontal upper surface at the upper end portion of the main body 31*b*. A moveable connection terminal portion 31*d* is arranged against this fixed terminal portion 31*c*. The lower end of this moveable connection terminal portion 31*d* continues to the main body 31*b* via a holding leg portion 31*e* given resiliency by the bending. Further, the operation terminal portion 31*e* is extended upward from the upper end of the moveable terminal portion 31*d*. Such a contact pin 31 is integrally formed by bending a plate made of a material having an excellent electroconductivity.

Note that, the upper end portion of the illustrated contact pin 31 performs the opening and closing operation, but the contact pin to be attached in the electric connecting apparatus of the present invention is not limited to a configuration in which the upper end portion thereof opens or closes. A configuration in which the upper end portion simply approaches and moves away from the projected electrode of the electric component by the displacement of the upper end portion can also be adopted.

Figure 6A:
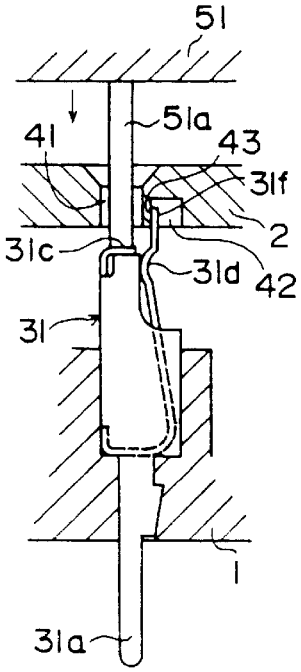
FIGS. 6A, 6B and 6C are sectional views of principal parts showing the relationship between a contact pin and the moving plate, respectively.
Figure 6B:
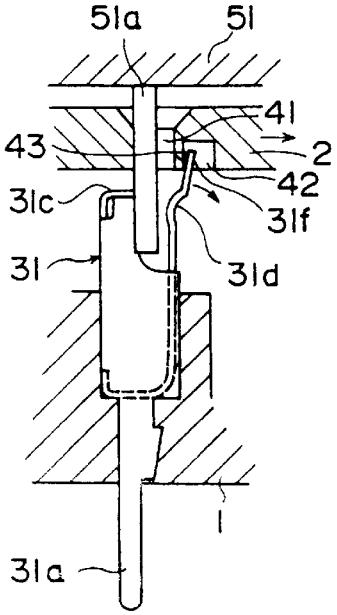
Figure 6C:
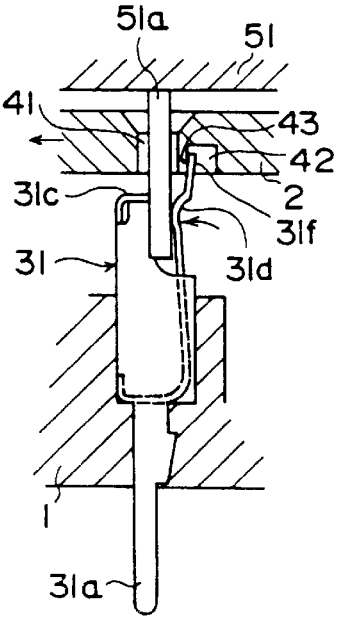

The contact pin 31 is held by the base member 1 and, at the same time, the upper end portion thereof is engaged with the moving plate 2 as shown in FIGS. 6A, 6B, and 6C. Namely, the contact pin 31 is press-fit into the base member 1 and fixed thereto by the main body 31*b* portion thereof, the upper portion of the main body 31*b* is positioned above the base member 2, and the lead portion 31*a* extends to below the base member 1. Note that while the illustration is omitted in FIGS. 6A to 6C, as illustrated in FIG. 5A, FIG. 5B, etc, a curved projection is formed in the portion of the operation terminal portion 31*f* of the upper end of the contact pin 31 which abuts against the moving plate 2, therefore the operation terminal portion 31*f* of the upper end of the contact pin 31 is always in linear contact with the moving plate 2 via this projection. Accordingly, a stable biasing force is always obtained.

An insertion port 41*b* is formed in the moving plate 2 corresponding to the position of the contact pin 31, and a recess 42 opening downward is formed in the vicinity of this insertion port 41. The operation terminal portion 31*f* of the contact pin 31 extends to the interior of the concave portion 42. The portion between the insertion port 41 and recess 42 of the moving plate 2 constitutes the pressing portion 43 which can press against the operation terminal portion 31*f* from the lateral direction.

In FIGS. 6A to 6C, reference numeral 51 denotes an electrical component such as an IC module and reference numeral 51*a* denotes a pin-like electrode projecting downward from the bottom surface thereof. In FIG. 6A, a state where a pin-like electrode 51*a* of the electric parts 51 is inserted into the insertion port 41 of the moving plate 2 and the lower end of the pin-like electrode 51*a* is made to abut against the upper surface of the fixed terminal 31*c* of the contact pin 31 is shown. Namely, the contact pin 31 is in the closed state.

FIG. 6B shows a state where the moving plate 2 is moved in the lateral direction from the state of FIG. 6A. At this time, the operation terminal portion 31*f* of the contact pin 31 is pressed by the pressing portion 43 of the moving plate 2, and the interval between the fixed terminal portion 31*c* and the moveable terminal portion 31*d* is broadened. Namely, the contact pin 31 is in the open state. Then, the pin-like electrode 51*a* of the electrical component 51 is positioned between the fixed terminal portion 31*c* and the moveable terminal portion 31*d* of the contact pin 31.

FIG. 6C shows a state where the moving plate 2 is returned leftward from the state of FIG. 6B. At this time, a state where the pin-like electrode 51*a* of the electrical component 51 is tightly gripped by the fixed terminal portion 31*c* and the moveable terminal portion 31*d* of the contact pin 31 is exhibited. Namely, the contact pin 31 has returned to the closed state.

Figure 1:
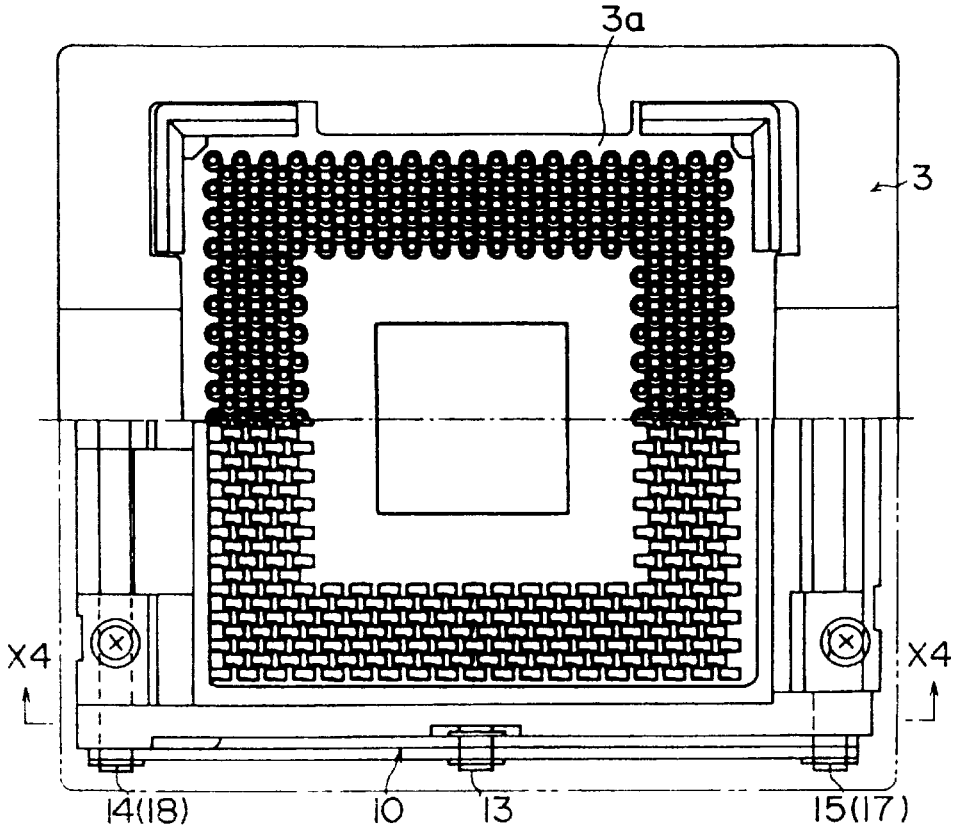
FIG. 1 shows one example of an electric connecting apparatus to which the present invention is applied and is a plan view showing a half of an operating member in a partially cutaway state.
Figure 2:
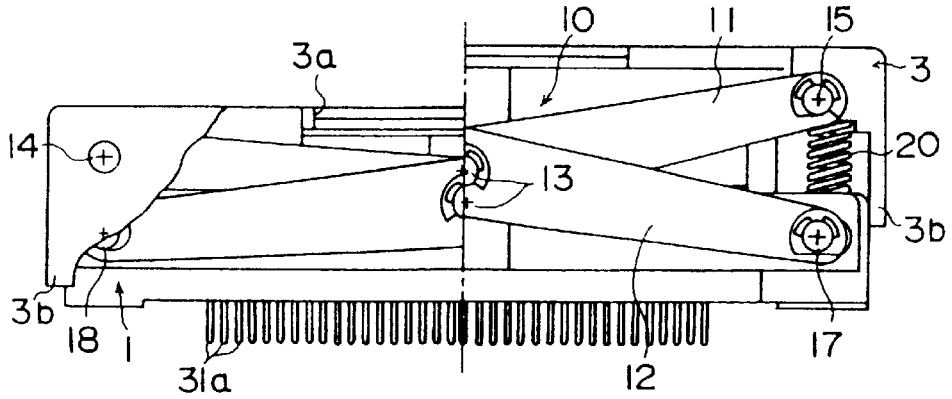
FIG. 2 is a partial sectional view of the front surface of the electric connecting apparatus of FIG. 1 and shows the heights of the operating member different between the left and right.
Figure 3:
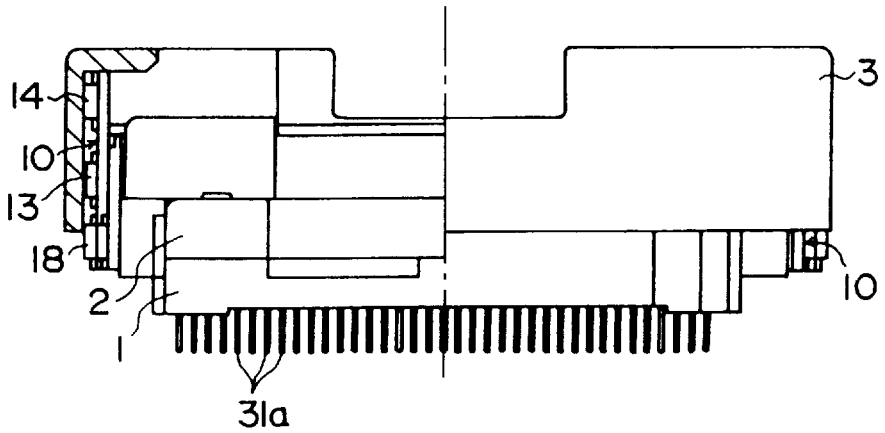
FIG. 3 is a partial sectional view of a right surface of the electric connecting apparatus of FIG. 1.
Figure 4:
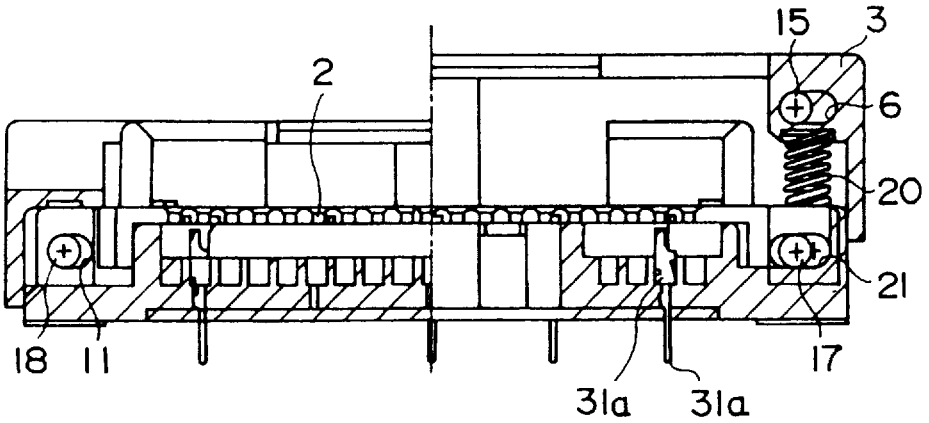
FIG. 4 is a sectional view of the electric connecting apparatus taken along a line X4—X4 in FIG. 1 and shows the heights of the operating member different between the left and right.

While the above explanation was made with reference to an embodiment, the present invention is not limited to this and includes for example the following modifications:

(1) The upper end portions of the link members 11 and 12 are made free in state and do not have to perform the affixing and connection utilizing a connection portion such as pin. Namely, it is also possible to exhibit a state where the upper end portions of the link members 11 and 12 are merely made to abut against the lower surface of the operating member 3 while capable of sliding in the lateral direction. In this case, so as to adjust the independent movement of the operating member 3 with respect to the base member 1, as shown in FIG. 2 and FIG. 7, it is also possible to extend the guide portion 3*b* which is extended downward from the periphery of the side surface of the operating member 3 and position this guide portion 3*b* on the outer periphery of the base member 1.

(2) It is also possible to return the operating member 3 to the upper position by utilizing the elastic returning force of the contact pins 31 to the closed state without providing the return spring 20.

(3) The electric connecting apparatus of the present invent ion can be used for a test of the electrical component 51. In addition to this, it is also possible to assemble it with the circuit substrate of an electronic apparatus such as for example a personal computer and use the same for mounting and connecting electrical components which are relatively frequently replaced. Of course, it is also possible to use the same as the connection terminal of the wiring cord.

As apparent from the above explanation, the present invention utilizes an X-shaped link mechanism constituting a toggle joint with respect to the base member and the moving plate, therefore it can provide an electric connecting apparatus which can greatly reduce the force for moving the moving plate for making the contact pins open.

I claim:

1. An electric connecting apparatus, comprising:

a base member holding a plurality of contact pins with upper end portions which can be displaced and a moving plate which is held by said base member so that it can move in a lateral direction relative to said base member, and which engages with the upper end portions of said contact pins;

an x-shaped link mechanism, connecting said base member and said moving plate, said X-shaped link mechanism constituting a toggle joint with respect to the base member and the moving plate;

wherein said X-shaped link mechanism has a pair of link members having the same length which are pivotally connected to each other at an intermediate position, one of the lower end portions of said pair of link members is pivotally connected to said base member and the other is pivotally connected to said moving plate, a first connection pin connecting one of the upper end portions of said pair of link members to an operating member, said first connection pin being one which can only pivot, a second connection pin, connecting the other of the upper end portions to said operating member, said second connection pin being operable to pivot and move in the lateral direction.

2. An electric connecting apparatus, comprising:

a base member holding a plurality of contact pins with upper end portions which can be displaced and a moving plate which is held by said base member so that it can move in a lateral direction relative to said base member, and which engages with the upper end portions of said contact pins;

an x-shaped link mechanism, connecting said base member and said moving plate, said X-shaped link mechanism constituting a toggle joint with respect to the base member and the moving plate;

wherein said X-shaped link mechanism has a pair of link members having the same length which are pivotally connected to each other at an intermediate position, one of the lower end portions of said pair of link members is pivotally connected to said base member and the other is pivotally connected to said moving plate, a first connection pin, connecting one of the upper end portions of said pair of link members to an operating member, said first connection pin being one which can only pivot, a second connection pin, connecting the other of said upper end portions being to said operating member, said second connection pin being fixed to said operating member and capable of pivot with respect to said link member and movement in the longitudinal direction thereof.

3. An electric connecting apparatus according to claim 1 or 2, wherein one of the lower end portions of said pair of link members is connected to said base member via a connection pin which can only pivot and the other is connected to said moving plate via a connection pin which can pivot and move in the lateral direction, and a return spring biasing said operating member upward is arranged between said operating member and said base member.

4. An electric connecting apparatus for mounting an electric component having electrodes thereon and allowing said electric component to be removed from a coupled circuit, comprising:

a base member holding a plurality of contact pins, having upper end portions which can be displaced laterally relative to the base member;

a moving plate which is held by said base member so that said moving plate can move in the lateral direction and which engages with said upper end portions of said contact pins;

an X-shaped link mechanism interconnecting said base member and said moving plate and constituting a toggle joint between said base member and said moving plate; and an operating member having an opening sized to permit the electric component to pass therethrough, said operating member supported by said X-shaped link mechanism so that operating member can move in the vertical direction with respect to said base member, wherein said X-shaped link mechanism includes first and second link members having upper and lower end portions, respectively, and also having substantially the same length and pivotally connected to each other at an intermediate position thereof, said first link member being pivoted at the lower end portion thereof to said base member, while said second link member being pivoted at the upper end portion thereof to said operating member.

5. An electric connecting apparatus according to claim 4 further comprising a connection pin, connecting said first link member at the upper end portion thereof to said operating member, said connection pin being fixed to said first link member and capable of pivot with respect to said operating member and capable of movement in the lateral direction.

6. An electric connecting apparatus according to claim 4 further comprising a connection pin, connecting said first link member at the upper end portion to said operating member, said connection pin being fixed to said operating member and capable of pivoting with respect to said first link member and movement in a longitudinal direction thereof.

7. An electric connecting apparatus according to claim 4, further comprising an elongated hole, formed in said moving plate, further comprising a connection pin, connecting said second link member at the lower end portion thereof to said moving plate, said connection pin being fixed to said first link member and capable of pivoting with respect to said moving plate and movement in the lateral direction within said elongated hole formed in said moving plate, and further comprising a return spring biasing said operating member upward, arranged between said operating member and said base member.

8. An electric connecting apparatus according to claim 5, further comprising an elongated hole, formed in said moving plate, further comprising a connection pin, connecting said second link member at the lower end portion thereof to said moving plate, said connection pin being fixed to said first link member and capable of pivoting with respect to said moving plate and movement in the lateral direction within said elongated hole formed in said moving plate, and further comprising a return spring biasing said operating member upward, arranged between said operating member and said base member.

9. An electric connecting apparatus according to claim 4 wherein said first and second link members of said X-shaped link mechanisms are arranged at opposite sides of said base member.

* * * * *